US005096094A

United States Patent [19]

Guilbert

[11] Patent Number: 5,096,094

[45] Date of Patent: Mar. 17, 1992

[54] MANUAL PUMP PRE-ORIENTABLE ON THE NECK OF A CONTAINER

[75] Inventor: Bruno Guilbert, Villeneuve Saint Georges, France

[73] Assignee: Aerosol Inventions and Development S.A. A.I.D. S.A., Switzerland

[21] Appl. No.: 568,187

[22] Filed: Aug. 16, 1990

[30] Foreign Application Priority Data

Sep. 8, 1989 [FR] France ..... 89 11746

[51] Int. Cl.[5] ..... B67D 5/32

[52] U.S. Cl. ..... 222/153; 222/321; 222/384

[58] Field of Search ..... 222/153, 384, 402.11, 222/402, 324, 383, 385

[56] References Cited

U.S. PATENT DOCUMENTS

| | | | |
|---|---|---|---|
| 3,149,757 | 9/1964 | Safianoff | 222/153 |
| 3,422,996 | 1/1969 | Lipman | 222/402.11 |
| 3,426,948 | 2/1969 | Stirling | 222/402.11 |
| 3,601,290 | 8/1971 | Nigro | 222/402.11 |
| 4,162,746 | 7/1979 | Anderson et al. | 222/153 |
| 4,318,498 | 3/1982 | Magers et al. | 222/153 |
| 4,565,302 | 1/1986 | Pfeiffer | 222/153 X |
| 4,865,228 | 9/1989 | Landecker | 222/384 X |
| 4,889,262 | 12/1989 | Toms | 222/384 X |
| 4,944,429 | 7/1990 | Bishop et al. | 222/384 X |
| 4,991,746 | 2/1991 | Schultz | 222/384 X |

FOREIGN PATENT DOCUMENTS 2530586 1/1984 France .

*Primary Examiner*—Kevin P. Shaver
*Attorney, Agent, or Firm*—Finnegan, Henderson, Farabow, Garrett & Dunner

[57] ABSTRACT

Oriented pump having a push-member-distributor (3) axially and angularly movable including at least one lug (35) cooperative with a blocking ramp having an indexed abutment for preventing and allowing at will the depression of the push-member and the disengagement of the push-member from bearing on the head of the piston (2). The seal is maintained between the push-member and the rod of the piston in all positions and the push-member is axially retained independently of the piston. The push-member is oriented on the neck of a given container at will when assembling the pump.

11 Claims, 1 Drawing Sheet

MANUAL PUMP PRE-ORIENTABLE ON THE NECK OF A CONTAINER

BACKGROUND OF THE INVENTION

The present invention relates to the packaging industry and more particularly to packaging for liquid or pasty substances, such as cosmetic, pharmaceutical or household maintenance products in container-distributors which are easily handled by the user.

Such container-distributors are commonly provided with a small piston pump controlled manually and fixed to the neck or often placed in the neck of a container. In order to avoid inopportune and involuntary actions, some of these pumps include a device for blocking the actuation of the piston which is rendered inoperative at will generally by cooperation between a part of a manual push-member and a blocking ramp connected to the pump body.

A pump of this type is in particular described in French Patent No. 2,530,586.

In such pumps, the push-member must be firmly fixed to the head of the piston so as to ensure that it does not become detached therefrom, in particular under the effect of the traction exerted by the push-member on the rod of the piston when the push-member rises up the blocking ramp. Consequently, it is the internal structure of the pump which is subjected to a more or less elastic deforming stretching which is harmful to its operation, at least in the long term.

Further, the push-member-distributors of these pumps are often laterally extended by a distribution nozzle having a more or less long nose and the containers are frequently more or less flat. It is therefore necessary, to achieve an improved aesthetic appearance and to facilitate handling, storage and packing, to arrange this nozzle so that it is oriented relative to the container. This orientation may be achieved by various known means, in particular by cooperative abutments of the neck of the container and the cap fixing the pump on the neck, and of the push-member and the ramp. This implies a specification of a pump for a given container and consequently a multiplication of the molds for manufacturing certain parts of the pumps and a costly limitation of mass-production.

SUMMARY OF THE INVENTION

An object of the invention is to provide a pump of the aforementioned type which is more reliable than conventional pumps owing to the absence of stress on the mechanism of the pump in the push-member blocking position, and which is orientable at will when it is assembled in accordance with the various structures of predetermined containers it is required to equip.

The invention provides a manual pump adaptable on the neck of a container for the distribution of liquid or pasty substances, in particular cosmetic, pharmaceutical and household maintenance products, comprising an annular cap adaptable on the neck for fixing thereon an axial pump body in which is slidable a piston which is reciprocatable under the action of a manual axially and angularly movable push-member, said push-member comprising a distribution nozzle and including a radial lug cooperative with a ring which is associated with the cap and the body and comprises a ramp against which a free end of the lug is capable of bearing, the upper part of the ramp preventing the depression of the piston and being angularly limited by a radial abutment, while the lower part of the ramp opens onto a longitudinal groove which allows the depression of the piston;

said pump being characterized in that the push-member is disconnected from the piston in the upper position of the ramp for blocking the push-member and freely bears against the head of the piston for the depression of the piston, and slidable sealing means are interposed between the smooth end part of the piston and the push-member.

According to a preferred embodiment, the push-member defines a blind cavity which receives with clearance the free end of the piston and whose inner end, which communicates with the distribution nose, includes a bearing abutment for the peripheral part of the free end of the piston, the open end of the cavity opening onto an open cylindrical part in which is slidable in a sealed manner an annular lip marginally extending from the free end of the piston, and the push-member includes axial retaining means cooperative with complementary means of the ring for retaining the push-member without hindering the freedom of rotation and depression of the piston, while allowing it to be disengaged from bearing against the free end of the piston in a locking position, when the lug bears against the upper part of the ramp.

The ring may include a plurality of ramps recessed in its inner wall and cooperative with as many lugs on the push-member, for example two diametrically opposed lugs cooperative with two diametrically symmetrical ramps on the ring.

The ring may advantageously include means for achieving an axial clipping or assembly by detent means and an angular immobilization in the cap, in particular by a flange for insertion into an annular cavity of the cap and at least one deformable radial lug for blocking in the axial opening of the cap through which the ring extends.

According to one embodiment, the annular cavity of the cap also receives an end flange for fixing the pump body, which flange includes means for sealingly bearing against the edge of the neck of the container and is axially maintained in the cavity by a clipping or detent action.

In order to achieve the desired orientation of the push-member relative to the container, the cap may include angular indexing means cooperative with complementary means of the neck of the container and of the ring.

In order to obtain a good axial guiding of the piston in the ring with reduced friction and a good stiffness of the piston, it is advantageous to arrange that the ring include internally an annular shoulder for freely guiding the piston and cooperative with at least three longitudinal ribs projecting from the lateral wall of the piston.

The polyvalent character of the essential component parts of the pump according to the invention may be still further improved by an ornamental outer sleeve which completely surrounds the cap and extends beyond the free edge of the push-member. This sleeve may include at least one internal rib for blocking in position by bearing against the edge of the cap.

BRIEF DESCRIPTION OF THE DRAWINGS

A better understanding of the invention will be had from the following detailed description of the accompanying drawings which represent one embodiment and a variant of the invention which are chosen merely as examples from the many embodiments, adaptations and variants of the invention which will occur to one skilled in the art.

In the drawings.

DESCRIPTION OF THE PREFERRED EMBODIMENTS

Figures 1, 2, 3, 4, 5, 6, 7, 8, 9, 10, 11, 12, 13, 14:
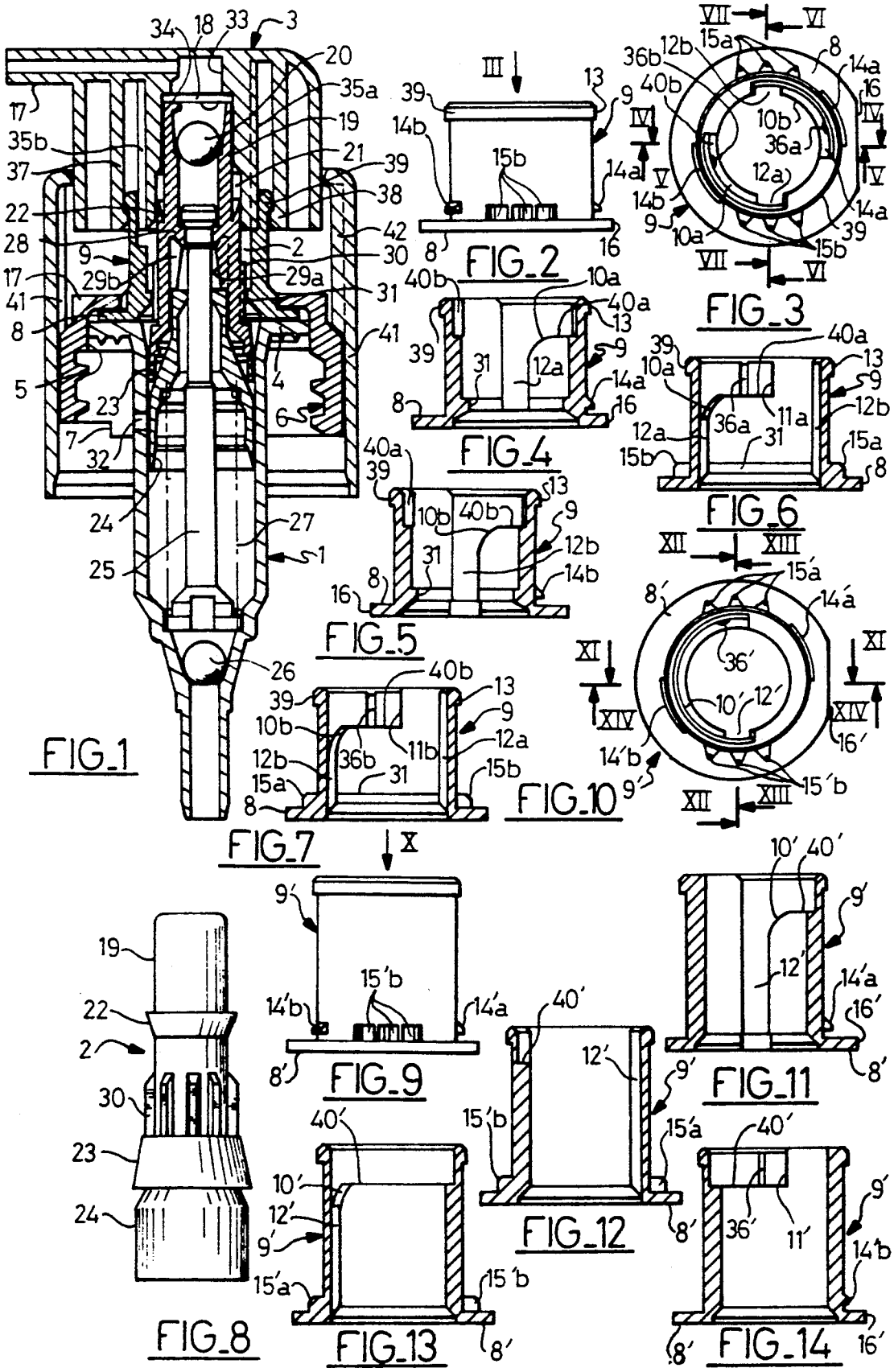
FIG. 1 is a diagrammatic elevational view, partly in diametrallongitudinal section, of a pump according to the invention having a double blocking ramp.
FIG. 2 is a diagrammatic elevational view of the ring having two ramps of the pump of FIG. 1.
FIG. 3 is a diagrammatic plan view of the ring of FIG. 2 in the direction indicated by the arrow III.
FIG. 4 is a diagrammatic diametrallongitudinal sectional view taken on line IV—IV of FIG. 3.
FIG. 5 is a diagrammatic diametrallongitudinal sectional view taken on line V—V of FIG. 3.
FIG. 6 is a diagrammatic diametrallongitudinal sectional view taken on line VI—VI of FIG. 3.
FIG. 7 is a diagrammatic diametrallongitudinal sectional view taken on line VII—VII of FIG. 3.
FIG. 8 is a diagrammatic elevational view of the piston of the pump of FIG. 1.
FIG. 9 is a diagrammatic elevational view of a variant of a pump ring according to the invention having a single ramp.
FIG. 10 is a diagrammatic plan view of the ring of FIG. 9 in the direction indicated by arrow X.
FIG. 11 is a diagrammatic diametrallongitudinal sectional view taken on line XI—XI of FIG. 10.
FIG. 12 is a diagrammatic diametrallongitudinal sectional view taken on line XII—XII of FIG. 10.
FIG. 13 is a diagrammatic diametrallongitudinal sectional view taken on line XIII—XIII of FIG. 10.
FIG. 14 is a diagrammatic diametrallongitudinal sectional view taken on line XIV—XIV of FIG. 10.

In these Figures, corresponding elements are designated by the same reference numerals, sometimes provided with an index. The respective dimensions and proportions of these elements are not necessarily respected in order to render the drawings more clear.

The pump according to the invention represented in FIGS. 1 to 8 of the drawings mainly comprises a pump body 1 in which is slidable a piston 2 under the action of a manual push-member-distributor 3. The pump body 1 is enlarged at its open end by a flange 4 inserted in an annular cavity 5 of a screw-threaded cap 6 to be fixed to the neck of a container (not shown) which has a corresponding screw thread. The skirt of the cap defines a step 7 which is cooperative with an abutment of the neck of the container for angularly determining, in the conventional manner, the position of the cap with respect to the container at the end of the screwing.

The cavity 5 of the cap also encloses an end flange 8 of a ring 9 whose inner wall defines, recessed therein, two ramps 10*a*, 10*b* which are in the shape of an arc of a circle and are diametrically symmetrical and each limited at the upper end respectively, at the end of a horizontal planar part 40*a*, 40*b*, by an abutment 11*a*, 11*b*, each ramp opening respectively at the lower end onto a longitudinal groove 12*a*, 12*b*. The upper end of the ring is surrounded by a ledge 13 and the lower end includes in proximity to the flange 8 two symmetrical ribs 14*a*, 14*b* which have the shape of an arc of a circle and are adapted to clip over or engage by a detent action the upper wall of the cap 6 under which the flange 8 is inserted. Two groups of deformable diametrically symmetrical lugs 15*a*, 15*b* project from the flange 8 against the lateral wall of the ring 9. These lugs, when the ring is forced into the axial opening of the cap 6 until the clipping or detent action occurs, deform and block the ring in the cap at the chosen orientation which is indicated, on one hand, by a flat face 16 on the flange 8 of the ring, and, on the other hand, by a recess 17 in the upper face of the cap 6.

The manual push-member-distributor 3 is radially extended in its upper part by a nose-shaped nozzle 17 which opens onto, through a narrowed part 33 acting as an annular abutment for the head 34 of the piston 2, an axial cavity 18 which freely receives the open end portion 19 of the tubular piston 2 in which is movable a delivery valve ball 20. The blind cavity 18 is extended by a cylindrical part 21 of larger diameter which receives in a sealed sliding manner an annular marginal lip 22 extending from the piston 2.

The piston 2 terminates in two stepped annular lips 23, 24 which are slidable in the pump body 1. An axial rod 25 disposed in the pump body 1 maintains at the bottom end a suction valve ball 26 and its base acts as a support for a return spring 27 for returning the piston to the upper position. The enlarged free end of the rod 25 is cooperative with an inner shoulder 28 of the piston 2 for ensuring the sealing of the pump at rest merely under the effect of the pressure exerted by the spring 27. This shoulder 28 is reinforced by internal radial ribs 29*a* and 29*b*. Other external radial ribs 30 in supporting relation to the lip 23 reinforce the piston and are cooperative, for ensuring a free guiding of the piston, with an inner annular bearing surface 31 in the ring 9. The stepped lips 23, 24 cooperate in a conventional manner with a lateral port 32 in the pump body 1 for sealing the pump, and consequently the container, at rest and for putting the interior of the container in communication with the atmosphere when the piston 2 is depressed.

The outer surface of the wall defining the axial cavity 18, 21 of the push-member-distributor 3 defines two diametrically opposed radial ribs 35*a*, 35*b* whose end faces of the free ends cooperate, in the manner of lugs, with the ramps 10*a*, 10*b* and the grooves 12*a*, 12*b* of the ring 9 for blocking or for allowing the depression of the push-member 3 and consequently the piston 2. Two small ribs 36*a*, 36*b* of the ring which are capable of being overcome cooperate with the flanks of the radial ribs 35*a*, 35*b* of the push-member to avoid any involuntary rotation of the push-member 3 when it is in the blocked position. The push-member 3 also comprises an internal median skirt 37 terminating in an inner bead 38 which cooperates, after an elastic clipping or detent action, with an outer bead 39 on the top of the ring 9 for preventing the push-member from escaping from the ring, and consequently from the pump, while allowing it full freedom to rotate and to be depressed.

The pump further comprises an ornamental outer sleeve 41 which extends upwardly and downwardly beyond the cap 9 and overlaps the free end of the push-member-distributor 3. Inner radial ribs 42 of the sleeve bear against the upper face of the ring 9 to ensure a good positioning of the sleeve when it is mounted with force on, or is adhered to, the cap 3.

Owing to this structure, it is possible to mass-produce, irrespective of its particular commercial destination, the whole of the mechanism of the pump. At the moment of assembling the ring in the cap, the desired orientation is chosen. The personalization of the pumps is achieved merely by the choice of the decoration of the sleeve and, possibly, of the push-member. All the elements are easily produced from molded plastics materials, the sleeve being possibly of metal or other material such as wood or leather.

In the embodiment shown in FIGS. 1 to 8, the user brings the pump from the blocking position in which the piston cannot be depressed, to the position of use, and inversely, merely by rotating the push-member-distributor through 90°.

The ring 9' having a single ramp 10' of the variant shown in FIGS. 9 to 14 is inserted in a pump similar to that shown in FIG. 1, with a push-member which has only a single rib 35. The single ramp 10' in the shape of an arc of a circle opens onto a longitudinal groove 12' and terminates at the upper end in a horizontal planar part 40' leading to an abutment 11' which is twice as long as the planar parts 40*a*, 40*b* of the ring 9 of the FIGS. 2 to 7.

With this variant, the distributor nozzle 17 of the push-member occupies, by rotation through 180°, two diametrically symmetrical positions, namely a blocked position and a position of use respectively, which may be an aesthetic advantage with certain forms of containers. On the other hand, with other forms, in particular with flat containers, it may be preferable to have a distributor nose of the push-member oriented in the same direction as the wider side of the container in the blocked position, which results in the smallest overall size, and in a direction perpendicular to this direction in the position of use for an improved projection of the nose relative to the side of the container, which is permitted by the ring having two ramps.

What is claimed is:

1. A manual pump adapted to be connected to the neck of a container, said pump comprising an axial pump body, a cap cooperating with said neck for fixing said pump body thereon, a piston slidable in said pump body in a reciprocating manner and having a free end part, an axially and angularly movable push-member loosely mounted onto the free end part of said piston for reciprocating said piston in said pump body, said push-member having at least an upper, non-depressed position and a lower depressed position, and at least a first angular position and a second angular position, said push-member having a distribution nozzle and at least one radial lug having a free end, a ring coaxially mounted with respect to said cap and said pump body and surrounding said piston at least partially, said ring having an inner wall with at least one longitudinal groove therein cooperating with said lug, whereby when said push-member is in said first angular position the lug is aligned with said groove permitting depression of said push-member and said piston to said lower depressed position, and at least one ramp therein having a lower part opening into said groove and an upper part angularly offset with respect to said groove, whereby rotation of said push-member to said second angular position while in said upper, non-depressed position aligns said lug with said upper part of said ramp preventing depression of said push-member and said piston, said upper part terminating in a radial abutment engageable by said lug to limit angular rotation of said push-member, said push-member being disconnected from said piston when said push-member is in said upper and second angular position and freely bearing against a head of said piston for the depression thereof, and slidable sealing means-disposed between said free end part of said piston and said push-member.

2. The pump of claim 1, wherein said push-member has a blind cavity and an open cylindrical portion communicating with said blind cavity and coaxial therewith, said free end part of said piston being located in said cavity, said cavity having an upper end which communicates with said distribution nozzle of said push-member and a bearing abutment for receiving a peripheral portion of said free end part of said piston, said cavity having a lower end opening into said open cylindrical part, an annular lip extending outwardly into said open cylindrical part, an annular lip extending outwardly from said free end part of said piston being slidably mounted in a sealed manner in said open cylindrical part, said push-member and said ring having mutually complementary engaging portions for axially retaining said push-member with respect to said piston without hindering said push-member's freedom of rotation and depression of said piston while allowing it to be disconnected form said free end part of said piston when said push-member is in said second angular position and said lug bears against said upper part of said ramp.

3. The pump of claim 1, wherein said push-member has at least one additional radial lug angularly offset from said at least one radial lug and said ring has at least one additional groove and at least one additional ramp in said inner wall thereof for cooperation with said at least one additional radial lug.

4. The pump of claim 3, wherein said additional lug is diametrically opposed to said at least one lug and said additional groove and ramp are diametrically symmetrical with said at least one groove and ramp.

5. The pump of claim 1, wherein said ring includes means for angularly immobilizing said ring in said cap.

6. The pump of claim 5, wherein said cap has an annular cavity and an axial opening therein, said ring extending through said axial opening and having a flange adapted to fit into in said annular cavity and at least one deformable radial lug for locking said ring with respect to said cap.

7. The pump of claim 6, wherein said annular cavity of said cap also receives a flange on said pump body, said pump body flange having means for sealingly bearing against the neck of the container when said cap is applied thereto and means for axially fixing said flange in said cavity of the cap.

8. The pump of claim 1, wherein said cap has angular indexing means for orienting the cap between said first and second angular portions, and complementary means on said ring cooperating therewith.

9. The pump of claim 1, wherein said ring has an internal annular shoulder for freely guiding said piston, at least three longitudinal ribs projecting from a lateral wall of said piston cooperating with said shoulder.

10. The pump of claim 1, comprising an outer sleeve completely surrounding said cap and extending beyond a free edge of said push-member.

11. The pump of claim 10, wherein said sleeve includes at least one internal blocking rib bearing against an edge of said cap.

* * * * *